US007017197B1

(12) United States Patent
Williams

(10) Patent No.: US 7,017,197 B1
(45) Date of Patent: Mar. 28, 2006

(54) ADJUSTABLE PLUNGER APPARATUS

(76) Inventor: Eric H. Williams, 2123 Southland Rd., Baltimore, MD (US) 21207

( * ) Notice: Subject to any disclaimer, the term of this patent is extended or adjusted under 35 U.S.C. 154(b) by 0 days.

(21) Appl. No.: 10/999,466

(22) Filed: Dec. 1, 2004

(51) Int. Cl.
*E03D 11/00* (2006.01)

(52) U.S. Cl. ..... 4/255.11

(58) Field of Classification Search ... 4/255.01–255.12
See application file for complete search history.

(56) References Cited

U.S. PATENT DOCUMENTS

| | | | | |
|---|---|---|---|---|
| 1,852,071 | A * | 4/1932 | Becker | 4/255.11 |
| 2,626,404 | A * | 1/1953 | Marks | 4/255.01 |
| 3,172,415 | A | 3/1965 | Maushund | |
| 3,315,280 | A * | 4/1967 | Krenn | 4/255.01 |
| D292,631 | S | 11/1987 | Tash | |
| 4,745,641 | A | 5/1988 | Tash | |
| 5,335,374 | A * | 8/1994 | Wilk et al. | 4/255.11 |
| 5,456,356 | A | 10/1995 | Kurzawa | |
| 5,524,296 | A * | 6/1996 | Leighton | 4/255.05 |
| 6,055,680 | A | 5/2000 | Tolbert | |
| 6,109,429 | A | 8/2000 | Cunningham et al. | |
| 6,789,276 | B1 * | 9/2004 | Leaphart et al. | 4/255.02 |

* cited by examiner

*Primary Examiner*—Justine R. Yu
*Assistant Examiner*—Huyen Le

(57) ABSTRACT

An adjustable plunger apparatus includes a plunger portion including an elongate shaft having opposed end portions rigidly connected to a suction portion at one of the end portions. The elongate shaft includes a depressible pin extending outwardly therefrom adjacent an opposed end portion of the shaft. The apparatus further includes a tube member having a hollow interior for receiving the shaft therein. The tube member includes an aperture for receiving the pin therethrough and for securely connecting the tube member to the plunger portion. A grip portion has a notch formed therein and an ashtray may be removably insertable into the notch. Alternately, a candleholder may be removably insertable into the notch. The apparatus may further include a base member for receiving the suction member therein during non-operating conditions.

15 Claims, 2 Drawing Sheets

ADJUSTABLE PLUNGER APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a plunger apparatus and, more particularly, to an adjustable plunger including a detachable plunger portion and a removable candleholder.

2. Prior Art

Conventional toilet plungers typically include an elongated wooden handle that is difficult to conceal and store. Accordingly, in public buildings, such as hotels and offices, a maintenance worker must manually transport the plunger from one location to another, which is unsanitary. Furthermore, even in household applications, conventional plungers will not always easily fit within a bathroom cabinet or closet. The present invention provides a plunger having an adjustable plunger portion for allowing the plunger to be conveniently and compactly stored within a confined location.

Moreover, conventional drain and toilet bowl plungers are generally characterized by being difficult to use. Thus, the rubber suction portion is initially very difficult to compress, then suddenly collapses. This causes a sudden shock on or surge to the drain and may loosen plumbing connections. Moreover, the rubber rim of the suction portion does not fit a toilet bowl properly to provide an effective seal, but slips around in the bowl, so that strong controlled pressure and vacuum cannot be exerted on the toilet drain to clear it of a blockage. While conventional plungers are generally better adapted for use in kitchen sinks, drain tubs and the like, they are seriously deficient for use with toilets, as pointed out above.

Accordingly, there remains a need for an improved drain blockage removing device which allows a smoothly controlled amount of pressure and vacuum to be exerted on a clogged drain, so as to protect the drain from damage, and which is easy and efficient to use. The device preferably should be durable and have readily replaceable parts. The seal exerted by the device should be improved over conventional plungers to provide quicker better drain clearing results. Such device should be capable of being made in a variety of efficient configurations at low cost from readily available materials.

BRIEF SUMMARY OF THE INVENTION

In view of the foregoing background, it is therefore an object of the present invention to provide an adjustable plunger apparatus. These and other objects, features, and advantages of the invention are provided by a plunger apparatus including a plunger portion including an elongate shaft having opposed end portions rigidly connected to a suction portion at one of the end portions. The elongate shaft includes a depressible pin extending outwardly therefrom adjacent an opposed end portion of the shaft.

The apparatus further includes a tube member having a hollow interior for receiving the shaft therein. The tube member includes an aperture for receiving the pin therethrough and for securely connecting the tube member to the plunger portion. The tube member is removable from the plunger portion by pressing the pin out from the aperture. The tube member further includes a plurality of handles having opposed end portions connected to the tube member respectively.

The apparatus preferably includes a grip portion including a mechanism for removably connecting same to the tube member. The connecting mechanism may include a conventional detent, for example. The grip portion has a notch formed therein and an ashtray may be removably insertable into the notch. Alternately, a candleholder may be removably insertable into the notch. The plurality of handles may be diametrically disposed along the tube member. The apparatus may further include a base member for receiving the suction member therein during non-operating conditions.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout, and prime and double prime notations are used to indicate similar elements in alternate embodiments.

Figure 1:
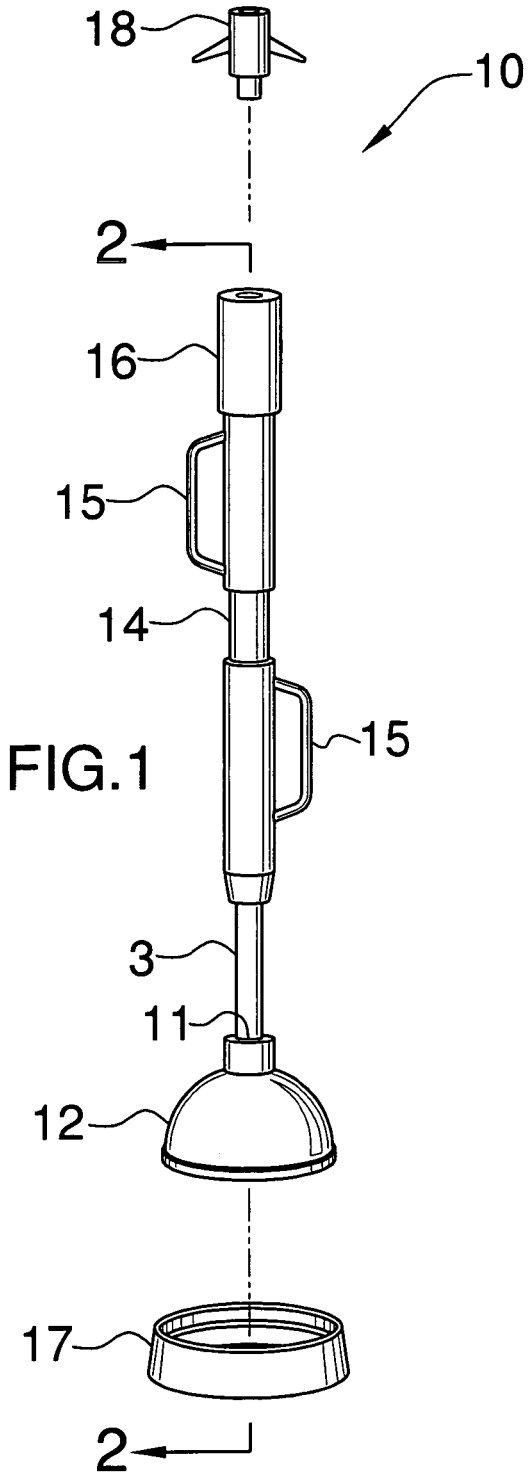
FIG. 1 is a perspective view showing a plunger apparatus, in accordance with the present invention.

The apparatus of this invention is referred to generally in FIG. 1 by the reference numeral 10 and is intended to provide an adjustable plunger apparatus for fixing clogged appliances. It should be understood that the apparatus 10 may be used to fix various household items and should not be limited to only fixing clogged toilets. The apparatus 10 includes a plunger portion 11 including an elongate shaft 13 having a bottom end portion secured to a conventional suction portion 12.

Shaft 13 has an upper end portion removably positionable within a hollow tube member 14 that extends upwardly from the plunger portion 11. Such a hollow tube member 14 includes a plurality of spaced handles 15 connected thereto at substantially diametrically opposed positions. A grip portion 16 is removably positionable on top of the tube portion 14 for assisting the user to operate the apparatus 10. A candleholder or ashtray 18 is removably positionable onto the grip portion 16 so that the user may insert a candle for providing additional light, as needed. The apparatus 10 further includes a base member 17 for receiving the suction portion 12 of the plunger portion 11 therein, when the apparatus is not being used.

Figure 2:
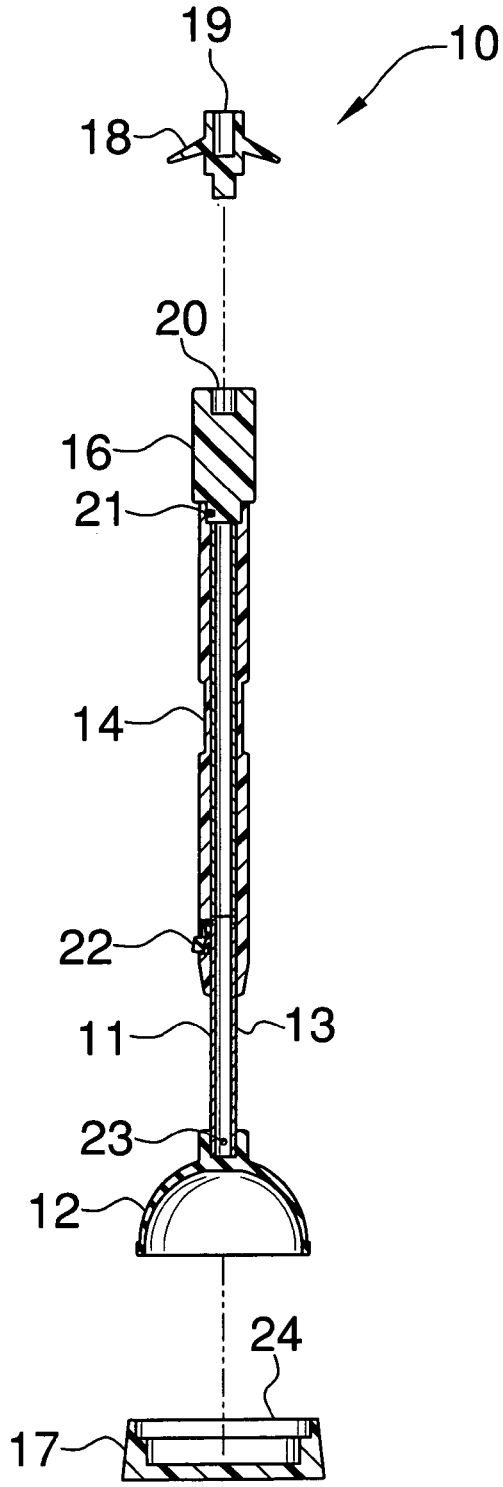
FIG. 2 is a cross-sectional view taken along line 2—2 in FIG. 1.

Now referring to FIG. 2, a cross-sectional view of the apparatus 10 is shown wherein the base number 17 includes a lip 24 formed around an interior perimeter thereof for receiving the suction portion 12 thereon and for allowing fluid to drain downwardly towards the bottom surface of the base member 17. Advantageously, the suction portion 12 will not rest in the fluid collected at the bottom surface of the base member 17.

Tube member 14 is provided with a hollow interior for slidably receiving the elongate shaft 13 therein. Such a shaft includes a pin 22 extending outwardly from a top portion thereof and may be inserted into a plurality of apertures (not shown) formed in the hollow tube member 14. Accordingly, plunger portion 11 may be secured within the tube member 14 by aligning pin 22 with one of the plurality of apertures. The bottom end portion of shaft 13 is secured to the suction portion 12 via a conventional fastener 23, as well known in the art.

Grip portion 16 includes a bottom portion removably positionable within an opening formed at the top end portion of the tube member 14. The bottom portion of the grip member 16 includes a conventional detent 21 including a ball adjustably engageable with the interior surface of the tube member 14, in a manner well known in the art. Accordingly, the grip portion 16 may be removably connected to the tube member 14 as desired by an operator.

Figure 3:
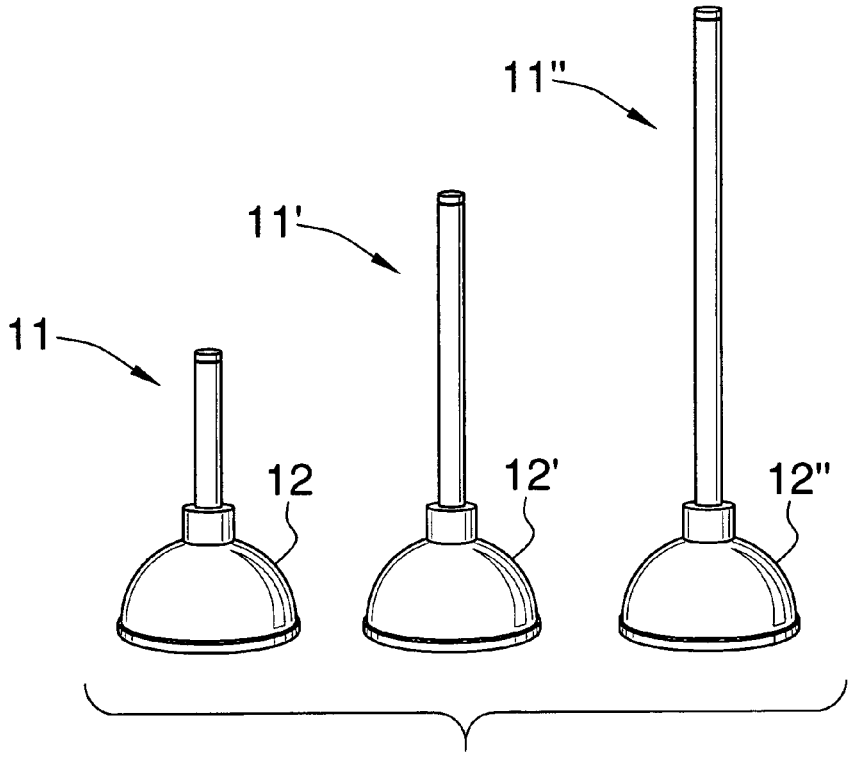
FIG. 3 is a perspective view showing alternate embodiments of the plunger portion shown in FIG. 1.

The upper end portion of the grip portion 16 has an aperture 20 for receiving the candleholder or ashtray 18. Such a candleholder or ashtray includes an opening 19 formed at a top portion thereof and for receiving a conventional candle or ashes from a cigarette, for example. Of course, various size plunger portions 11 may be employed by the present invention, as perhaps best shown in FIG. 3. Advantageously, a clogged drain that is located at a close location can be fixed by using plunger portion 11 or 11'. Alternately, if a clogged drain is located far away, plunger portion 11" may be employed. In addition, the size of the suction portion 12 may be adjusted for fixing various sized toilet drains and sink drains, for example.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A plunger apparatus comprising:

a plunger portion including an elongate shaft having opposed end portions rigidly connected to a suction portion at one said end portion, said elongate shaft including a depressible pin extending outwardly therefrom adjacent an opposed said end portion;

a tube member having a hollow interior for receiving said shaft therein, said tube member including an aperture for receiving said pin therethrough and for securely connecting said tube member to said plunger portion, said tube member being removable from said plunger portion by pressing said pin out from said aperture, said tube member including a plurality of handles having opposed end portions connected to said tube member respectively; and a grip portion including means for removably connecting same to said tube member;

wherein said grip portion has a notch formed therein and said apparatus further comprises a candleholder removably insertable into said notch.

2. The plunger apparatus of claim 1, wherein said grip portion has a notch formed therein and said apparatus further comprises an ashtray removably insertable into said notch.

3. The plunger apparatus of claim 1, wherein said plurality of handles are diametrically disposed along said tube member.

4. The plunger apparatus of claim 1, wherein said connecting means comprises a detent.

5. The plunger apparatus of claim 1, further comprising a base member for receiving said suction member therein during non-operating conditions.

6. An adjustable plunger apparatus comprising:

a plunger portion including an elongate shaft having opposed end portions rigidly connected to a suction portion at one said end portion, said elongate shaft including a depressible pin extending outwardly therefrom adjacent an opposed said end portion;

a tube member having a hollow interior for receiving said shaft therein, said tube member including an aperture for receiving said pin therethrough and for securely connecting said tube member to said plunger portion, said tube member being removable from said plunger portion by pressing said pin out from said aperture, said tube member including a plurality of handles having opposed end portions connected to said tube member respectively;

a grip portion including means for removably connecting same to said tube member, said grip portion having a notch formed therein; and a candleholder removably insertable into said notch.

7. The plunger apparatus of claim 6, wherein said grip portion has a notch formed therein and said apparatus further comprises an ashtray removably insertable into said notch.

8. The plunger apparatus of claim 6, wherein said plurality of handles are diametrically disposed along said tube member.

9. The plunger apparatus of claim 6, wherein said connecting means comprises a detent.

10. The plunger apparatus of claim 6, further comprising a base member for receiving said suction member therein during non-operating conditions.

11. An adjustable plunger apparatus comprising:

a plunger portion including an elongate shaft having opposed end portions rigidly connected to a suction portion at one said end portion, said elongate shaft including a depressible pin extending outwardly therefrom adjacent an opposed said end portion;

a tube member having a hollow interior for receiving said shaft therein, said tube member including an aperture for receiving said pin therethrough and for securely connecting said tube member to said plunger portion, said tube member being removable from said plunger portion by pressing said pin out from said aperture, said tube member including a plurality of handles having opposed end portions connected to said tube member respectively;

a grip portion including means for removably connecting same to said tube member, said grip portion having a notch formed therein; and an ashtray removably insertable into said notch.

12. The plunger apparatus of claim 11, wherein said grip portion has a notch formed therein and said apparatus further comprises an candleholder removably insertable into said notch.

13. The plunger apparatus of claim 11, wherein said plurality of handles are diametrically disposed along said tube member.

14. The plunger apparatus of claim 11, wherein said connecting means comprises a detent.

15. The plunger apparatus of claim 11, further comprising a base member for receiving said suction member therein during non-operating conditions.

* * * * *